US009440443B2

(12) United States Patent
Arimizu et al.

(10) Patent No.: US 9,440,443 B2
(45) Date of Patent: Sep. 13, 2016

(54) LIQUID EJECTING HEAD AND LIQUID EJECTING APPARATUS

(71) Applicant: CANON KABUSHIKI KAISHA, Tokyo (JP)

(72) Inventors: Hiroshi Arimizu, Kawasaki (JP); Masahiko Kubota, Tokyo (JP); Nobuhito Yamaguchi, Inagi (JP); Arihito Miyakoshi, Tokyo (JP); Koichi Ishida, Tokyo (JP); Yoshinori Itoh, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/217,646

(22) Filed: Mar. 18, 2014

(65) Prior Publication Data

US 2014/0313259 A1 Oct. 23, 2014

(30) Foreign Application Priority Data

Apr. 19, 2013 (JP) ..... 2013-088521
Feb. 17, 2014 (JP) ..... 2014-027713

(51) Int. Cl.
*B41J 2/17* (2006.01)
*B41J 2/165* (2006.01)

(52) U.S. Cl.
CPC ..... *B41J 2/1721* (2013.01); *B41J 2/1714* (2013.01); *B41J 2002/1728* (2013.01)

(58) Field of Classification Search
CPC ..... B41J 2/1721; B41J 2/1714; B41J 2002/1728
See application file for complete search history.

(56) References Cited

U.S. PATENT DOCUMENTS

| | | | | |
|---|---|---|---|---|
| 8,075,120 | B2 | 12/2011 | Ide et al. | |
| 8,287,089 | B2 | 10/2012 | Kimura et al. | |
| 2006/0238561 | A1 | 10/2006 | Carcia et al. | |
| 2007/0229584 | A1* | 10/2007 | Hirato | 347/30 |
| 2011/0109693 | A1* | 5/2011 | Ohnishi | 347/34 |

FOREIGN PATENT DOCUMENTS

JP 2010-137483 A 6/2010

OTHER PUBLICATIONS

Furmidge, "Studies at Phase Interfaces, I. The Sliding of Liquid Drops on Solid Surfaces and a Theory for Spray Retention", Journal of Colloid Science, 17, pp. 309-324, 1962.

* cited by examiner

*Primary Examiner* — Stephen Meier
*Assistant Examiner* — Alexander D Shenderov
(74) *Attorney, Agent, or Firm* — Fitzpatrick, Cella, Harper & Scinto

(57) ABSTRACT

A liquid ejecting head is provided with a suction port capable of avoiding the return of mists, which have already been sucked through a suction port, back to the suction port. In view of this, the inner diameter of a suction tube for allowing liquid mists taken in through the suction port to pass is designed such that a meniscus is formed before a liquid droplet adhering to the inside of the suction tube grows enough to move toward the suction port.

8 Claims, 11 Drawing Sheets

FURMIDGE EQUATION

C. G. L. Furmidge; J. Colloid Sci., 17, 309 (1962)

$$mg\sin\alpha = W \cdot \gamma_{Lv} \cdot (\cos\theta_r - \cos\theta_a)$$

$\theta_a$: ADVANCE CONTACT ANGLE $\theta_r$: RETREAT CONTACT ANGLE $\alpha$: INCLINATION ANGLE w: WIDTH (DIAMETER) OF LIQUID DROPLET $\gamma_{Lv}$: INTERFACIAL ENERGY BETWEEN LIQUID DROPLET AND WALL

LIQUID EJECTING HEAD AND LIQUID EJECTING APPARATUS

BACKGROUND OF THE INVENTION

1. Field of the Invention

The present invention relates to a liquid ejecting head for ejecting liquid in accordance with a liquid jetting system so as to perform printing on a print medium, and a liquid ejecting apparatus having the same. In particular, the present invention relates to the optimization of a liquid suction tube provided for avoiding adhering or dropping of liquid droplets to or from the surface of a liquid ejection port.

2. Description of the Related Art

In a liquid ejecting apparatus for ejecting liquid so as to print an image on a print medium, sub droplets smaller than main droplets or fine liquid droplets (i.e., mists or droplets of mist) splashing on the print medium float between a liquid ejecting head and the print medium, and therefore, they may smear various kinds of equipment housed inside of the apparatus. For example, in a case where droplets of mist adhere to a pinch roller for pressing the print medium, liquid irrelevant to image formation may be unintentionally transferred onto the print medium together with the rotation of the roller. Moreover, in a case where mists adhere in the vicinity of an ejection port of a liquid ejecting head, and then, dry, the ejection port is obstructed with the resultant adhering mists. Consequently, the ejection cannot be normally carried out, thereby possibly degrading the quality of an image.

In contrast, U.S. Patent Laid-Open No. 2006/0238561 or Japanese Patent Laid-Open No. 2010-137483, for example, discloses a configuration in which an air suction port is formed in the vicinity of a liquid ejecting head, thus sucking mists floating with air. The configuration disclosed in U.S. Patent Laid-Open No. 2006/0238561 or Japanese Patent Laid-Open No. 2010-137483 can effectively remove mists floating between the liquid ejecting head and a print medium so as to suppress any smear on an image with the mists.

However, even if mists are once sucked through a suction port into a liquid pathway, they coalesce into a large liquid droplet in the pathway, and then, the resultant coalesced large liquid droplet drops from the suction port, thereby possibly smearing a print medium or the inside of an apparatus.

SUMMARY OF THE INVENTION

The present invention has been accomplished to solve the above-described problem. Therefore, an object of the present invention is to provide a liquid ejecting head provided with a suction tube capable of avoiding the return of mists, which have been once sucked from a suction port, to the suction port.

In a first aspect of the present invention, there is provided a liquid ejecting head comprising: a surface having a plurality of ejection ports for ejecting liquid and a suction port for taking in atmosphere containing liquid mists; and a suction tube for allowing the liquid mists taken in through the suction port to pass therethrough, wherein the suction tube has an inner diameter L of a size sufficient to form a meniscus before a liquid droplet adhering to the inside of the suction tube coalesces and grows to a size large enough to begin moving toward the suction port.

In a second aspect of the present invention, there is provided a liquid ejecting apparatus for printing an image on a print medium by using a liquid ejecting head for ejecting liquid, the liquid ejecting head comprising: a surface having a plurality of ejection ports for ejecting liquid and a suction port for taking in atmosphere containing liquid mists; and a suction tube for allowing the liquid mists taken in through the suction port to pass therethrough, wherein the suction tube has an inner diameter L of a size sufficient to form a meniscus before a liquid droplet adhering to the inside of the suction tube coalesces and grows to a size large enough to begin moving toward the suction port.

In a third aspect of the present invention, there is provided a liquid ejecting apparatus for printing an image on a print medium by using a liquid ejecting head for ejecting liquid, wherein the liquid ejecting head comprises: a surface having a plurality of ejection ports for ejecting liquid and a suction port for taking in atmosphere containing liquid mists; and a suction tube for allowing the liquid mists taken in through the suction port to pass therethrough, the inner diameter L satisfying the following inequality:

$$L \leq (1/2) \cdot \{(12 \cdot \gamma Lv/(\rho \cdot g \cdot \pi)\}^{1/2}$$

wherein ρ designates the density of liquid; g, gravity acceleration; and γLv, an interfacial energy between the liquid and the inner wall of the suction tube.

In a fourth aspect of the present invention, there is provided a liquid ejecting head comprising: a surface having a plurality of ejection ports for ejecting liquid and a suction port for taking in atmosphere containing liquid mists; and a suction tube for allowing the liquid mists taken in through the suction port to pass therethrough, the inner diameter L satisfying the following inequality:

$$L \leq (1/2) \cdot \{(12 \cdot \gamma Lv/(\rho \cdot g \cdot \pi)\}^{1/2}$$

wherein ρ designates the density of liquid; g, gravity acceleration; and γLv, an interfacial energy between the liquid and the inner wall of the suction tube.

In a fifth aspect of the present invention, there is provided a liquid ejecting head comprising: a surface having a plurality of ejection ports for ejecting liquid and a suction port for taking in atmosphere containing liquid mists; and a suction tube for allowing the liquid mists taken in through the suction port to pass therethrough, wherein the suction tube has an inner diameter L of 250 μm or less.

Further features of the present invention will become apparent from the following description of exemplary embodiments (with reference to the attached drawings).

DESCRIPTION OF THE EMBODIMENTS

First Preferred Embodiment

Figure 1A:
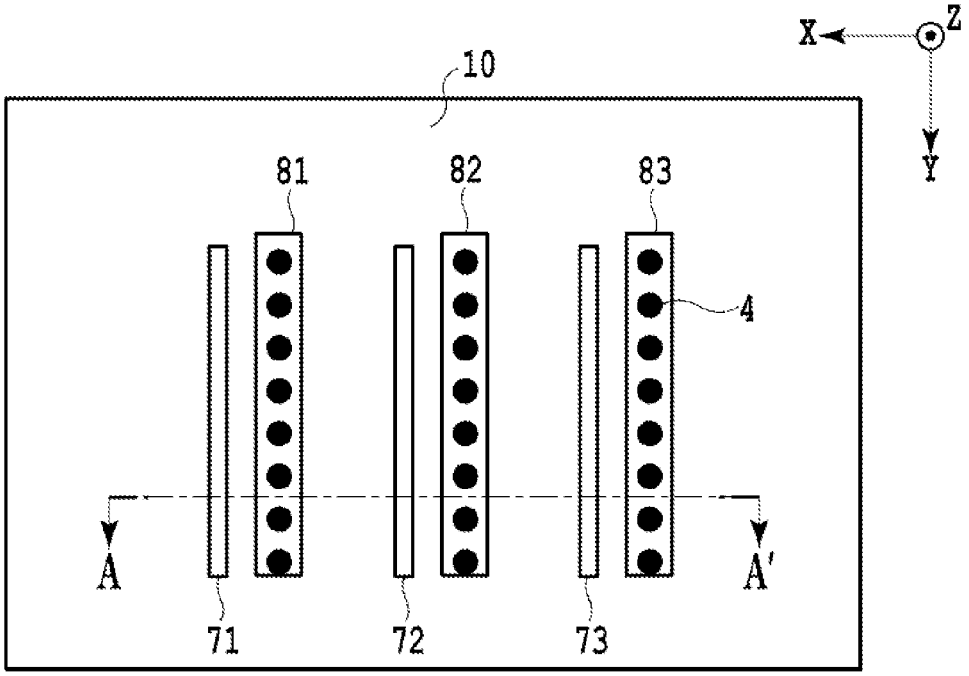
FIGS. 1A and 1B are a plan view and a cross-sectional view showing a liquid ejecting head, respectively.
Figure 1B:
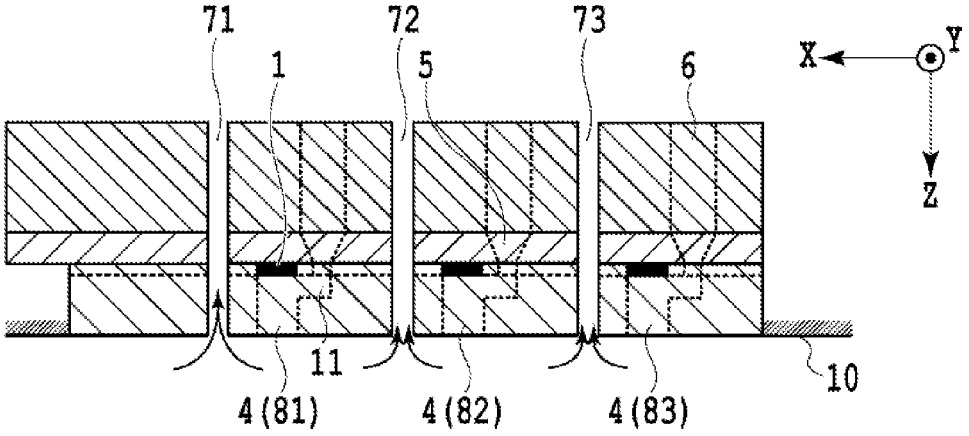

FIGS. 1A and 1B are a plan view and a cross-sectional view taken along a line A-A', respectively, showing an ejection port formation surface 10 of a liquid ejecting head to be used in a liquid ejecting apparatus typifying an ink jet printing apparatus in the present embodiment. The liquid ejecting head ejects liquid such as ink from nozzles based on image data, so that an image is printed on a print medium. Here, there is shown the liquid ejecting head provided with three nozzle arrays 81 to 83 and three gas suction ports 71 to 73.

Each of the nozzle arrays 81 to 83 has a plurality of ejection ports 4 arrayed in a Y direction. Liquid is supplied from a common supply chamber 6 to a foaming chamber 11 connected to the plurality of ejection ports 4 through a supply path 5. A heater 1 is located at a position corresponding to each of the ejection ports. The heater 1 is driven in response to a print signal, so that film boiling of the liquid occurs inside of the foaming chamber, whereby the liquid is ejected from the ejection port in the form of a droplet by growth energy of produced foam. Behind the liquid ejecting head is provided a gas suction device, not shown, and thus, air and mists staying in the vicinity of the ejection port are taken in from the gas suction port 71 formed sideways of the nozzle array in a direction indicated by an arrow.

Figure 2:
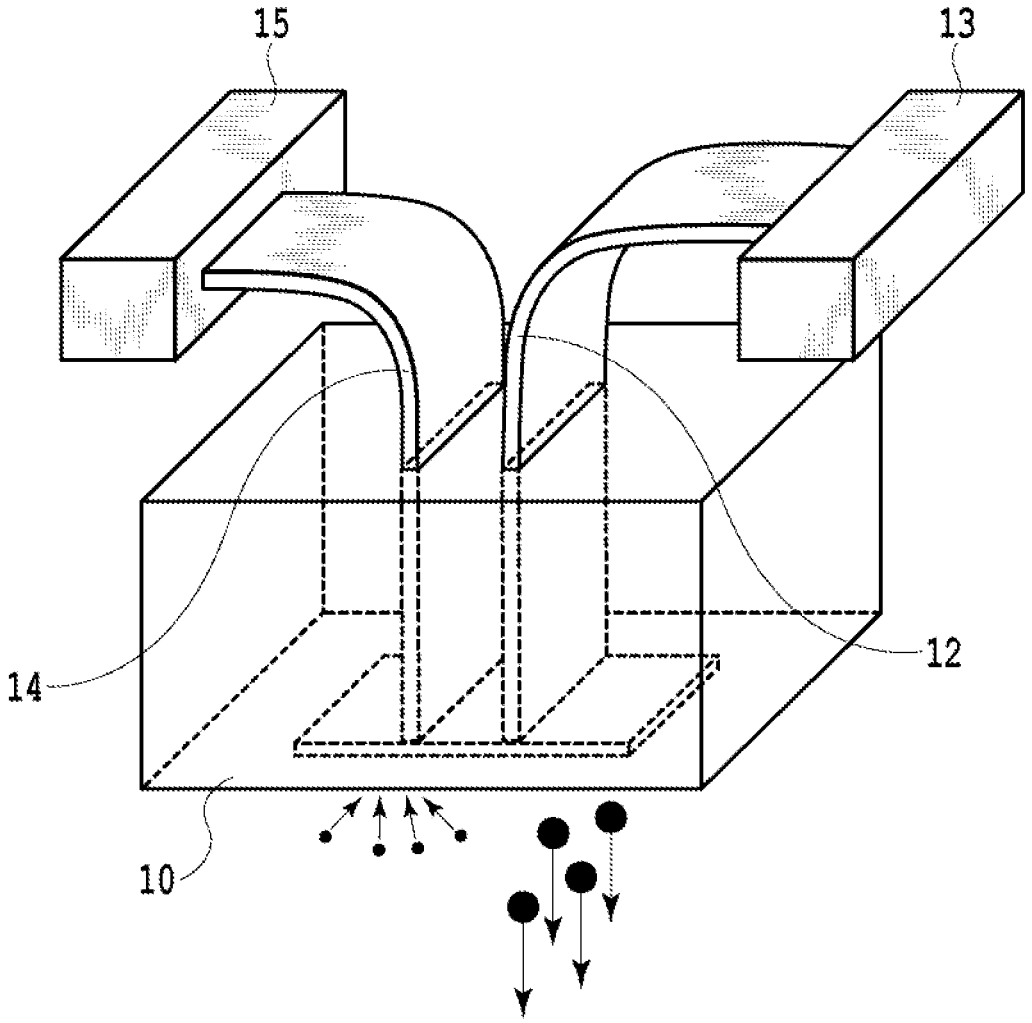
FIG. 2 is a view showing a system for supplying liquid to and taking in gas from the liquid ejecting head.

FIG. 2 is a view showing a system for supplying liquid and taking in gas to and from the liquid ejecting head 2. Here, a set of the nozzle array 82 and the gas suction port 72 is shown for the sake of simplification. To a liquid supplying device 13 is connected a liquid supplying tube 12 that is connected to the supply chamber 6 that has been explained with reference to FIG. 1B. With this configuration, the liquid contained in the liquid supplying device 13 is adapted to be supplied to each of the plurality of nozzles arrayed on the nozzle array 82.

In the meantime, to a gas suction device 15 is connected a suction tube 14 that extends up to the gas suction port 72 opened at the ejection port formation surface 10 of the ejecting head. The gas suction device 15 can produce a negative pressure inside thereof, and thus, sucks atmosphere through the gas suction port 72 under the negative pressure. At this time, normal liquid droplets ejected from the ejection port 4 cannot be sucked through gas suction ports 72 but fine mists floating in the vicinity of the ejection port formation surface 10 are taken in through the gas suction ports 72. On the way of the suction tube 14 for letting liquid mists pass may be disposed a mist recovering chamber for separating gas and mists from each other. In order to keep the constant suction amount of gas irrespective of mist recovery amount, there may be prepared a valve or the like for adjusting the suction force of the gas suction device 15 according to the amount of sucked mists. The detailed structures of the suction tube 14 and the gas suction ports 72 will be described later.

Figure 3:
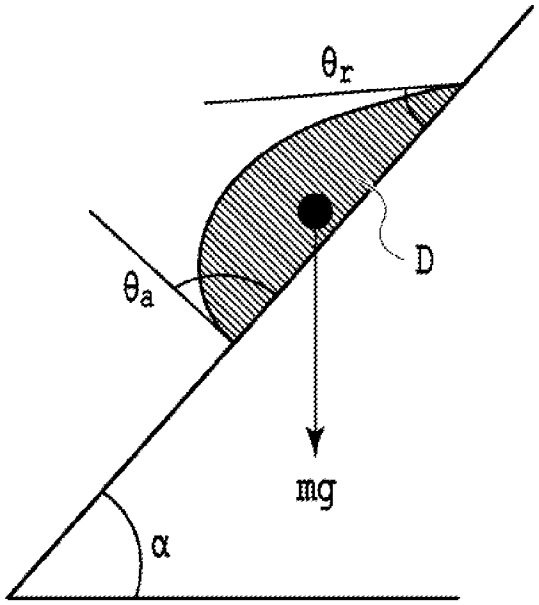
FIG. 3 is a diagram illustrating the relationship between forces to be exerted on a liquid droplet adhering onto an inner wall of a suction tube.

FIG. 3 is a diagram illustrating the relationship between forces to be exerted on a liquid droplet adhering onto the inner wall of the suction tube 14. Some of the mists sucked by the suction tube 14 adhere onto the inner wall of the suction tube 14 while being aggregated by their own surface tension, thereby forming a liquid droplet D. Here, α represents an angle of an inner wall with respect to a horizontal plane; θa, an advance contact angle in the direction of the gravity of the liquid droplet D; θr, a retreat contact angle; W, the diameter of the liquid droplet D (i.e., the diameter of a contact surface); m, a mass; γLv, an interfacial energy between the liquid droplet D and the inner wall; and g, a gravity acceleration. In this case, the relationship between the forces to be exerted on the liquid droplet D can be expressed by the following Furmidge Equation 1.

See C. G. L. Furmidge; J. Colloid Sci., 17,309 (1962).

$$m \cdot g \cdot \sin \alpha = W \cdot \gamma Lv \cdot (\cos \theta r - \cos \theta a) \qquad \text{Equation 1}$$

In a case where the left-hand side in Equation 1 is smaller than the right-hand side, that is, $m \cdot g \cdot \sin \alpha / \{W \cdot \gamma Lv \cdot (\cos \theta r - \cos \theta a)\} \leq 1$, the liquid droplet stays on the inner wall. In contrast, in a case where the left-hand side in Equation 1 is greater than the right-hand side, that is, $m \cdot g \cdot \sin \alpha / \{W \cdot \gamma Lv \cdot (\cos \theta r - \cos \theta a)\} > 1$, the liquid droplet moves downward on the inner wall.

Assuming that, for example, α is 90°; θa, 90°; and θr, 0°, Equation 1 shows $m \cdot g = W \cdot \gamma Lv$.

Alternatively, assuming that the liquid droplet D per se is hemispherical, wherein ρ represents the density of liquid and π represents the circular constant, the mass m of the liquid droplet can be expressed by $(\rho \cdot \pi \cdot W^3)/12$, and therefore, the diameter W of the liquid droplet D in a case where the liquid droplet D starts to move in the direction of gravity can be expressed by the following Equation 2:

$$\{(12 \cdot \gamma Lv / (\rho \cdot g \cdot \pi)\}^{1/2} \qquad \text{Equation 2}$$

Figure 4:
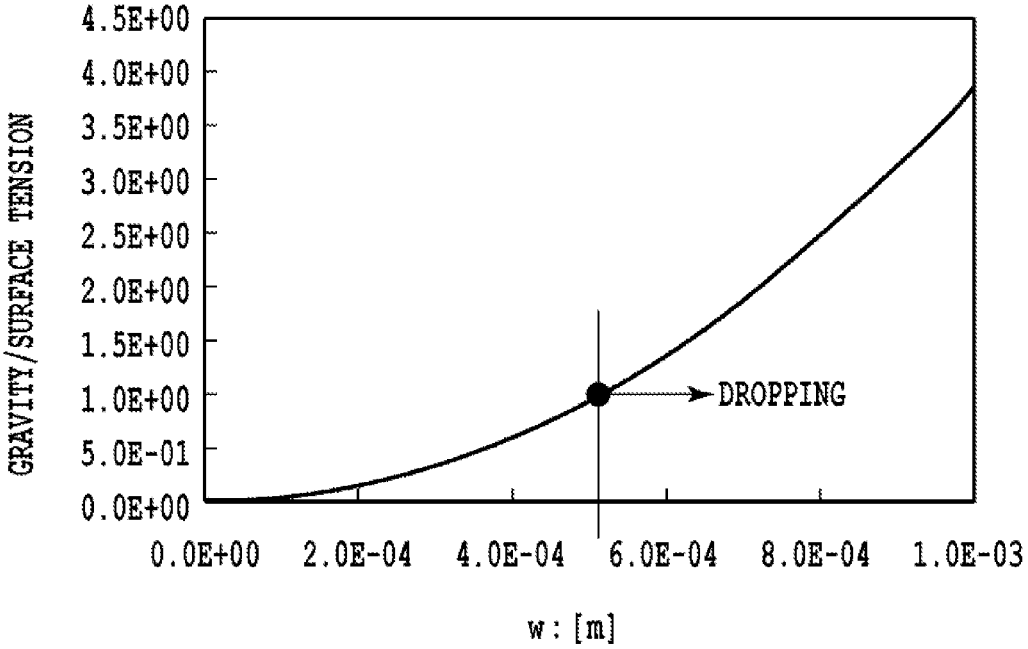
FIG. 4 is a graph illustrating the relationship between the ratio of gravity to surface tension and the diameter of the liquid droplet.

FIG. 4 is a graph illustrating the left-hand side/the right-hand side of Equation 1 with respect to the diameter W of the liquid droplet D in a case where γLv=0.04 N/m. In a case where a value on a vertical axis exceeds 1, that is, the diameter W of the liquid droplet D exceeds 500 μm, the gravity exerted on the liquid droplet D becomes larger than the surface tension for allowing the liquid droplet D to stay on the wall, and therefore, the liquid droplet D moves downward. In this manner, timing at which the liquid droplet D starts to move depends on its size (i.e., the diameter).

However, in a case where the liquid droplet D forms a meniscus in the suction tube before the liquid droplet D grows enough to start to move, the surface energy γLv acts on the entire circumference of meniscus (i.e., the entire circumference of liquid droplet). Specifically, the balance of forces in Equation 1 can be expressed by the following Equation 3:

$$m \cdot g \cdot \sin \alpha = W \cdot \pi \cdot \gamma Lv \cdot (\cos \theta r - \cos \theta a) \qquad \text{Equation 3}$$

For example, in FIG. 4, in a case where the vertex of the liquid droplet D is brought into contact with an opposite side on the inner wall of the suction tube 14 before the diameter W of the liquid droplet D exceeds 500 μm with reference to FIG. 3, that is, the inner diameter of the suction tube 14 is 250 μm or less, the above-described meniscus M can be formed in the suction tube 14 before the liquid droplet D drops.

Figure 5A:
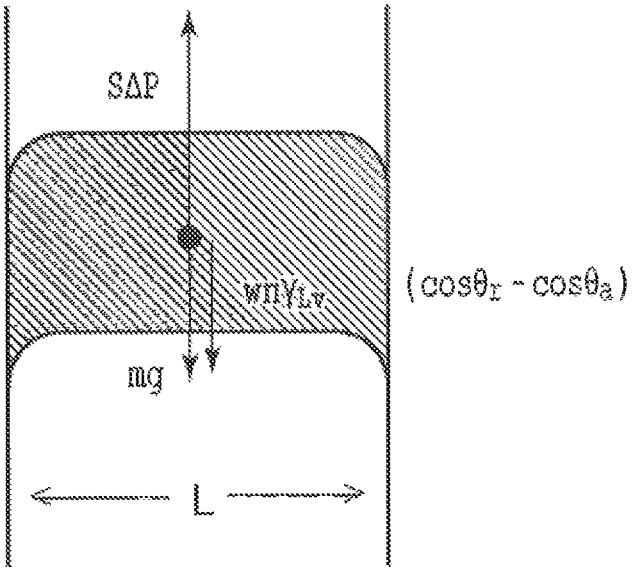
FIGS. 5A and 5B are views showing a state in which a meniscus is formed inside of the suction tube.
Figure 5B:
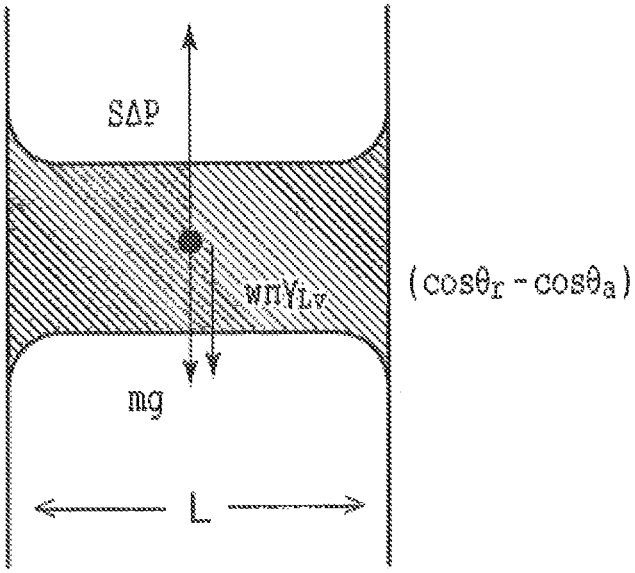

FIGS. 5A and 5B are views showing a state in which the meniscus M is formed inside of the suction tube 14. The shape of the meniscus M is shown in either FIG. 5A or FIG. 5B according to an inner pressure in the direction to the gas suction device 15. The formation of the above-described meniscus M per se prevents atmospheric communications inside of the suction tube, so that the suction force of the gas suction device 15 effectively acts on the meniscus M, thus expecting the secure suction of the mists.

In a case where the meniscus starts to move, assuming that S designates the cross-sectional area of the suction tube 14 and ΔP denotes a difference between an inner pressure inside of the suction tube 14 separated by the meniscus M in the direction to the gas suction device and an atmospheric pressure, the relationship between the forces acting on the meniscus M is expressed by Equation 4:

$$m \cdot g \cdot \sin \alpha + W \cdot \pi \cdot \gamma Lv \cdot (\cos \theta r - \cos \theta a) = S \cdot \Delta P \qquad \text{Equation 4}$$

Figure 6:
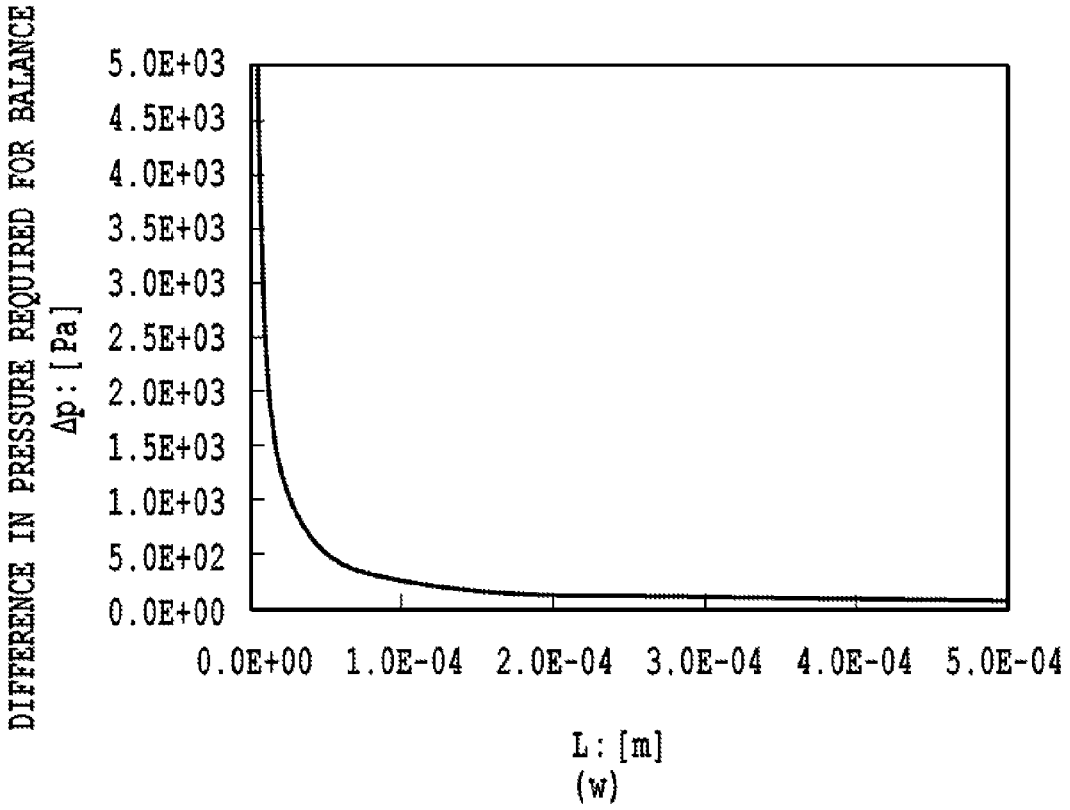
FIG. 6 is a graph illustrating the relationship between the diameter of the meniscus and a difference ΔP in pressure for causing the meniscus to move.

FIG. 6 is a graph illustrating the relationship between the diameter of the meniscus M, that is, the inner diameter L of the suction tube 14 and a difference ΔP in pressure for causing the meniscus to move. Here, γLv is 0.04 N/m, like FIG. 4, and further, the advance contact angle θa is 63° and the retreat contact angle θr is 0° by way of an example of the inner wall of a stainless suction tube. Referring to FIG. 6, in a case where the diameter W of the meniscus M, that is, the inner diameter of the suction tube 14 is 500 μm, the meniscus M can be sucked with a pressure difference ΔP of 200 Pa. This value can be satisfactorily achieved by a general negative pressure generating device (i.e., a pump).

In view of the above-described phenomenon, the present inventors have judged that it is effective to design the suction tube 14 having an inner diameter adjusted such that the meniscus M is formed before the liquid droplet D grows enough to drop, in taking in the mists through the suction tube 14. Specifically, the suction tube 14 is designed such that the inner diameter L of the suction tube 14 becomes smaller than the diameter of the liquid droplet D which starts to move in the direction of the gravity, that is, a half of W in Equation 2 (i.e., the radius of the liquid droplet).

$$L \leq (1/2) \cdot \{(12 \cdot \gamma Lv / (\rho \cdot g \cdot \pi)\}^{1/2} \qquad \text{Equation 5}$$

With the inner diameter L satisfying Equation 5, even if the aggregation of the mists produces the liquid droplet on the way of the suction tube 14, the liquid droplets cannot drop from the gas suction ports 71 to 73 but can be securely sucked by the gas suction device 15. However, the forces that actually act on the liquid droplet D are not limited to those illustrated in FIG. 3, but they depend on the surface roughness (i.e., the shape) of the inner wall of the suction tube 14, chemical decoration, a liquid composition, or the like. Consequently, it is preferable that the graphs illustrated in FIGS. 4 and 6 should be made based on actual measurement for each of types of liquid, and thus, the inner diameter L of the suction tube 14 should be adjusted based on the resultant actual values.

Since the inner diameter L of the suction tube 14 such designed as described above is very small, a region where the mists can be taken in by a single suction tube 14 is small. In view of this, a plurality of suction tubes 14, each having the inner diameter L, are arranged in one gas suction port in the present embodiment.

Figure 7A:
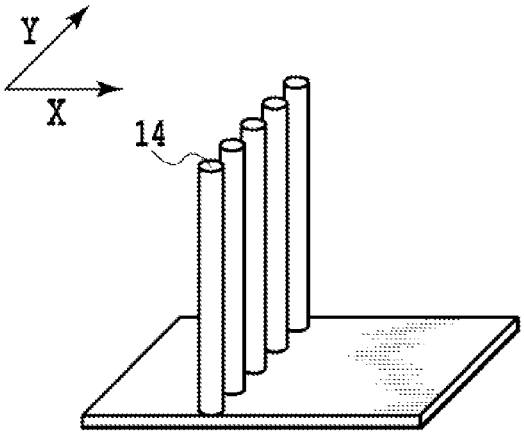
FIGS. 7A to 7F are views showing constitutional examples of the arrangement of a plurality of suction tubes.
Figure 7B:
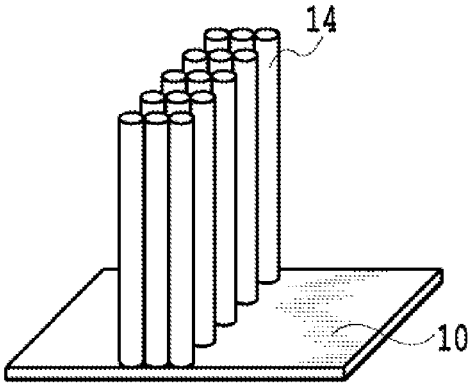
Figure 7C:
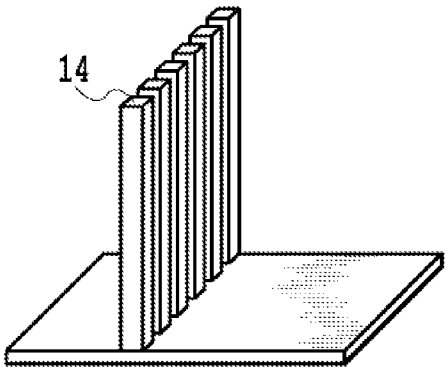
Figure 7D:
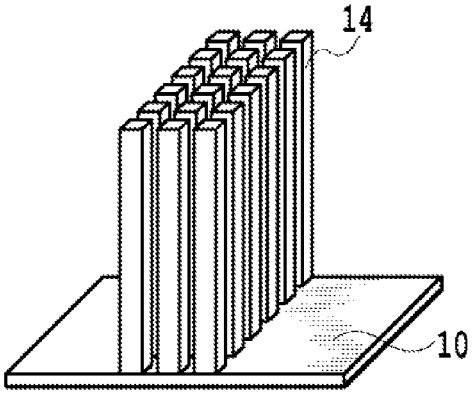
Figure 7E:
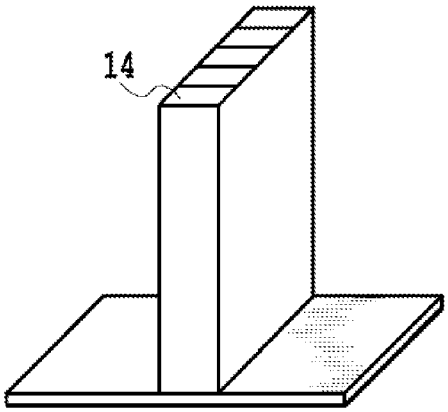
Figure 7F:
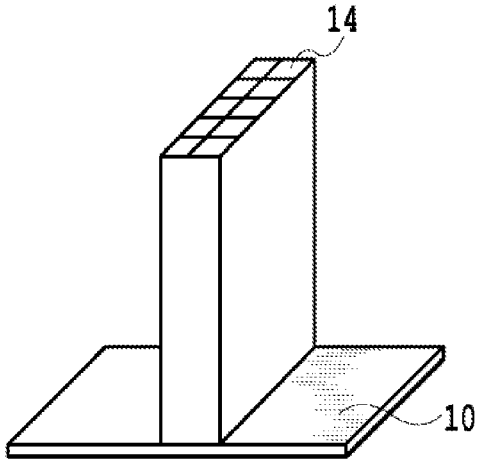

FIGS. 7A to 7F are views showing constitutional examples of the arrangement of a plurality of suction tubes 14. FIG. 7A illustrates a configuration in which a plurality of cylindrical suction tubes 14 are arranged at the ejection port formation surface 10 in a Y direction; and FIG. 7B illustrates a configuration in which the plurality of cylindrical suction tubes 14 are arranged on an X-Y plane. Moreover, FIG. 7C illustrates a configuration in which a plurality of rectangular suction tubes 14 are arranged at the ejection port formation surface 10 in the Y direction; and FIG. 7D illustrates a configuration in which the plurality of rectangular suction tubes 14 are arranged on the X-Y plane. Additionally, FIG. 7E illustrates a configuration in which one suction tube 14 includes a plurality of partitions that define a plurality of regions in the Y direction. In addition, FIG. 7F illustrates a configuration in which one suction tube 14 includes a plurality of partitions that define a plurality of regions in the X and Y directions. The suction tube may be formed into various polygonal shapes, although not illustrated here. Any configurations may be acceptable as long as each of the suction tubes 14 or each of the partitioned regions has the inner diameter L enough to form a meniscus before the liquid droplet grows enough to drop, specifically, the inner diameter L satisfying Equation 5.

Second Preferred Embodiment

Explanation will be made of a printing apparatus capable of supplying steam for suppressing the fixation of liquid in the present embodiment. In the case of such a printing apparatus, a suction tube 14 sucks steam in addition to atmosphere and liquid mists, and therefore, a liquid droplet containing much water adheres onto the inner wall of the suction tube 14. At this time, the suction tube 14 takes in a greater quantity of liquefied component than that in the first embodiment. However, water generally has a larger interfacial energy (i.e., surface tension) than that of a liquid droplet in most cases, and therefore, an inner diameter suitable for the suction tube 14 is different from that in the first embodiment.

Figure 8A:
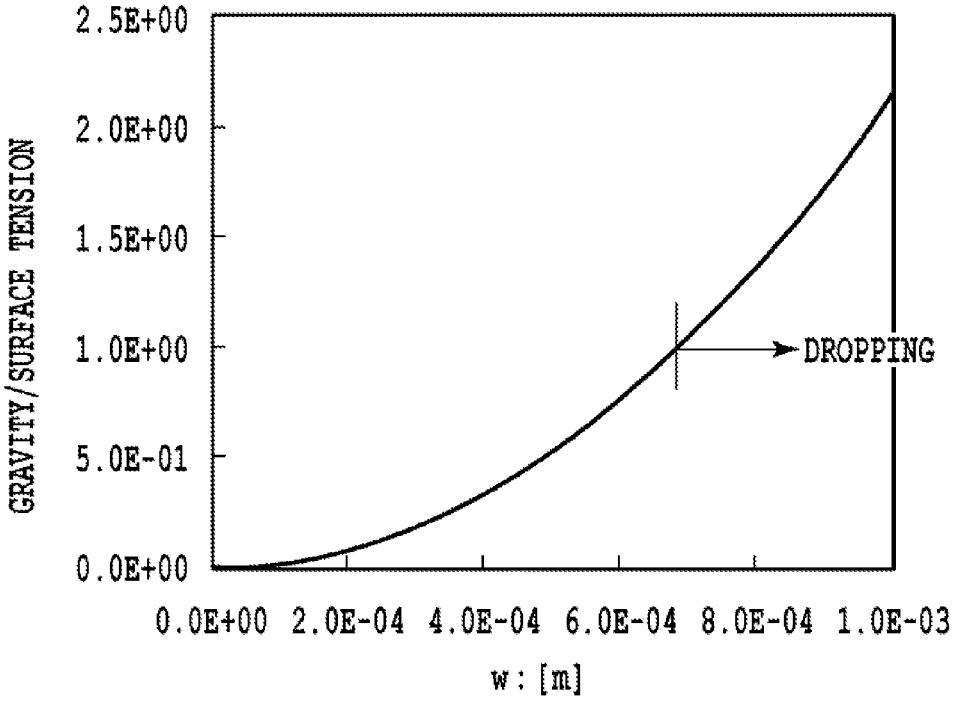
FIGS. 8A and 8B are graphs illustrating the relationship between the ratio of gravity to surface tension and the liquid droplet and the relationship between the diameter of the meniscus and the difference ΔP in pressure for causing the meniscus to move, respectively.
Figure 8B:
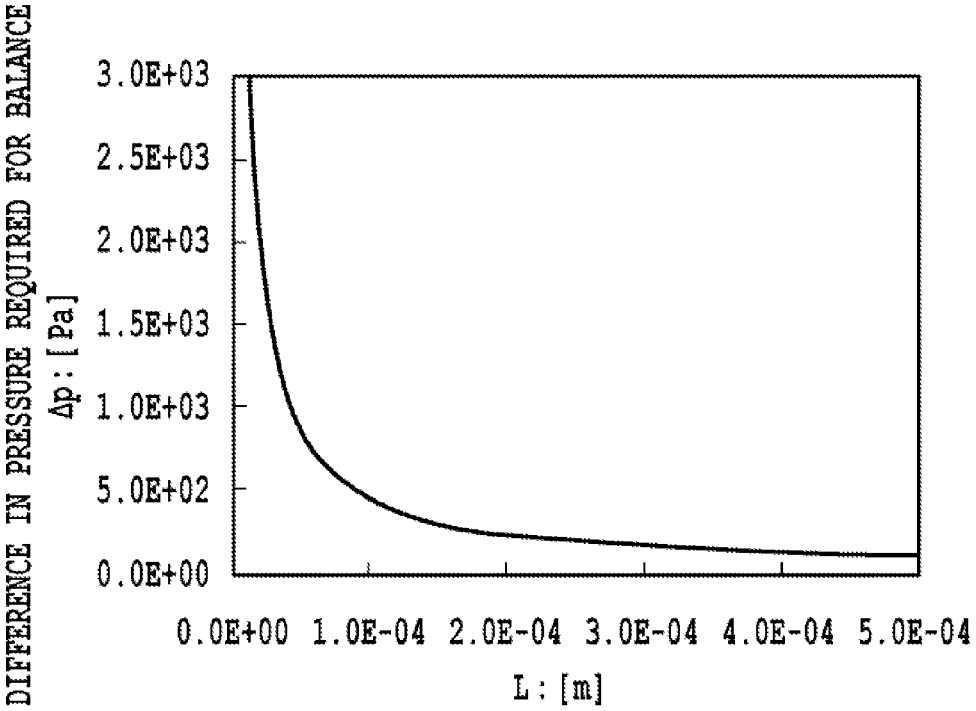

FIGS. 8A and 8B are, in the case of a liquid droplet containing water as a main component, a graph illustrating the left-hand side/the right-hand side in Equation 1 with respect to the diameter W of a liquid droplet D and a graph illustrating the inner diameter L of the suction tube 14 with respect to a pressure difference ΔP required for moving a meniscus M, respectively. Here, the interfacial energy (i.e., the surface tension) γLv is 0.072 N/m, and further, an angle α of an inner wall surface with respect to a horizontal plane, an advance contact angle θa and a retreat contact angle θr in the direction of the gravity of the liquid droplet D are set to α=90°, θa=90°, and θr=0°, respectively, like in the first preferred embodiment.

Referring to FIGS. 8A and 8B, in the case of liquid containing water as a main component, in a case where the diameter W of the liquid droplet D exceeds 680 μm, the liquid droplet D moves downward: in contrast, in a case where the inner diameter of the suction tube 14 is 340 μm or less, a meniscus M can be formed before the liquid droplet D drops. In this case, the meniscus M can be sucked with a pressure difference ΔP of 150 Pa.

Third Preferred Embodiment

A description will be given of a printing apparatus that uses liquid having a lower surface tension than that of general liquid in the present embodiment.

Figure 9A:
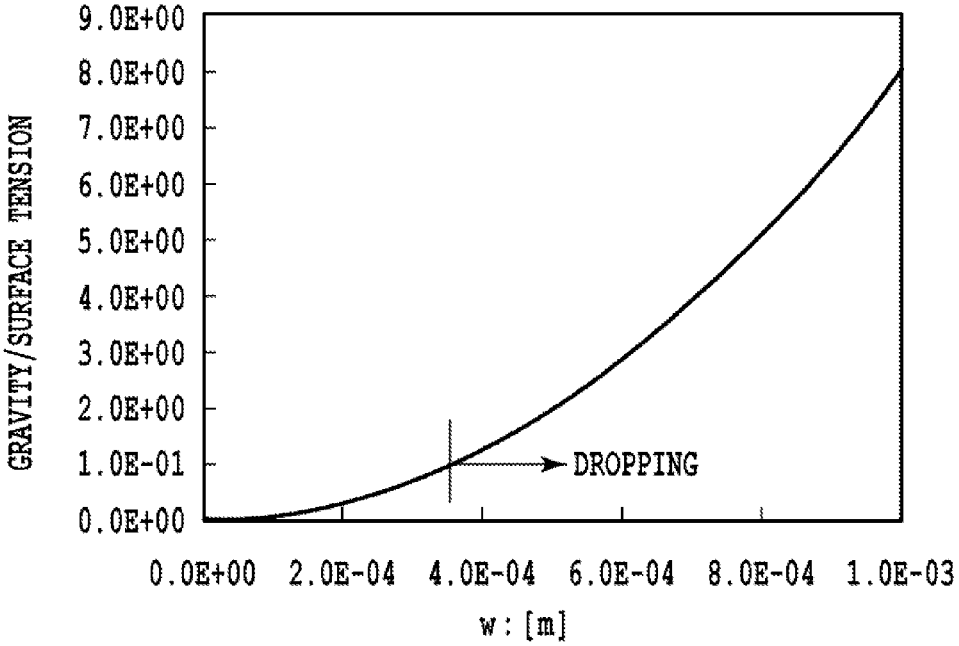
FIGS. 9A and 9B are other graphs illustrating the relationship between the ratio of gravity to surface tension and the liquid droplet and the relationship between the diameter of the meniscus and the difference ΔP in pressure for causing the meniscus to move, respectively.
Figure 9B:
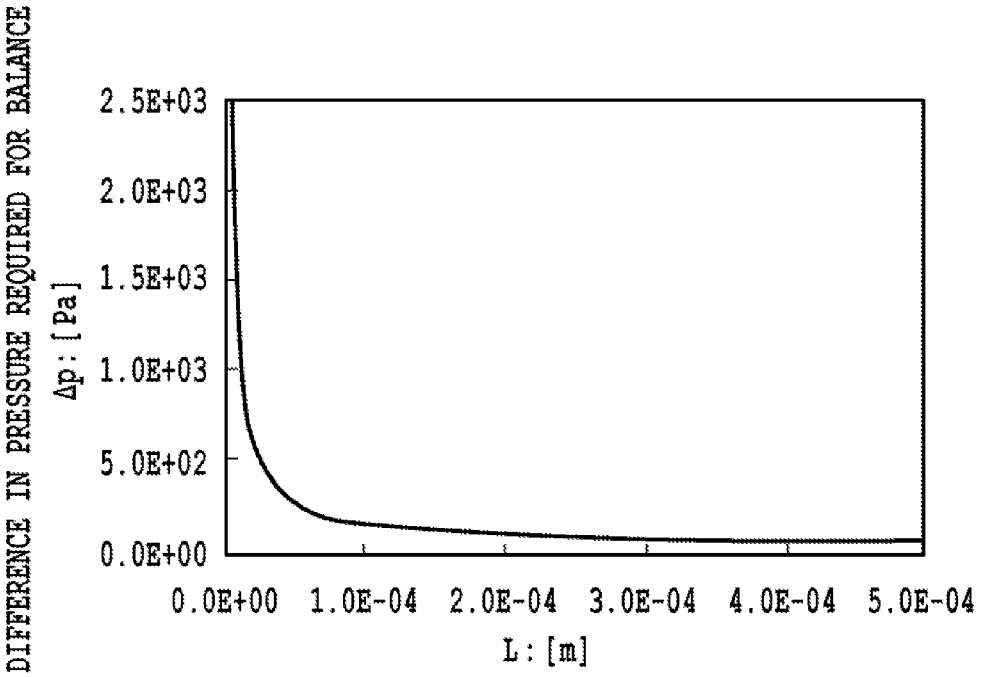

FIGS. 9A and 9B are, in the case of a surface tension γLv of 0.02 N/m, a graph illustrating the left-hand side/the right-hand side in Equation 1 with respect to the diameter W of a liquid droplet D and a graph illustrating the inner diameter L of the suction tube 14 with respect to a pressure difference ΔP required for moving a meniscus M, respectively. Also in the present preferred embodiment, an angle α of an inner wall surface with respect to a horizontal plane, an advance contact angle θa in the direction of the gravity of the liquid droplet D, and a retreat contact angle θr are set to α=90°, θa=90°, and θr=0°, respectively, like in the first preferred embodiment.

Referring to FIGS. 9A and 9B, in the case of a surface tension γLv=0.02 N/m, in a case where the diameter W of the liquid droplet D exceeds 360 μm, the liquid droplet D moves downward, however if the inner diameter of the suction tube 14 is 180 μm or less, a meniscus M can be formed before the liquid droplet D drops. In this case, the meniscus M can be sucked with a pressure difference ΔP=80 Pa.

As described above, according to the present invention, there is prepared the suction tube having the inner diameter L enough to form the meniscus before the liquid droplet grows to drop so that the mists once sucked through the gas suction port can be avoided from returning to the gas suction port.

Figure 10:
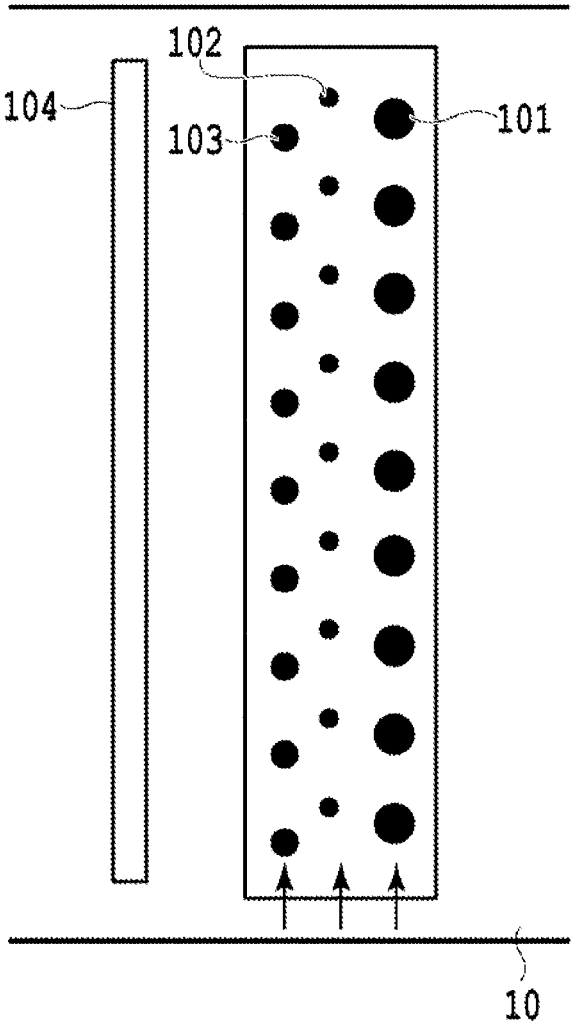
FIG. 10 is a view showing the configuration provided with a plurality of ejection ports having different port diameters.

Incidentally, although the gas suction ports 71 to 73 are prepared for the three nozzle arrays 81 to 83, respectively, in the mode in FIG. 1, the number or type of nozzle arrays is not limited to this. For example, as shown in FIG. 10, the ejection port formation surface 10 may be provided with a plurality of ejection port arrays having different port diameters capable of ejecting liquid droplets in different amounts. FIG. 10 shows a configuration in which there are arranged an array 101 consisting of ejection ports for ejecting a liquid droplet of 5 pl, an array 102 consisting of ejection ports for ejecting a liquid droplet of 1 pl, an array 103 consisting of ejection ports for ejecting a liquid droplet of 2 pl, and a single suction port 104 corresponding to the three arrays. The type or number of ejection port arrays may be varied according to the type of liquid to be ejected. For example, one array of nozzles may be provided for a yellow liquid whose granularity is not really conspicuous on a print medium, like in the first preferred embodiment: in contrast, three arrays of nozzles having different ejection amounts may be provided for a black liquid whose granularity is conspicuous, as shown in FIG. 10. At this time, since the yellow and black liquids have different surface tensions γLv or densities ρ, the inner diameter of the liquid suction tube 14 or the number of arrays may be individually adjusted with respect to the yellow and black liquids.

Although the description has been given above of the configuration in which a system including the gas suction device 15 as a negative pressure generating device and the suction tube 14 connected to the gas suction device 15 is prepared for suctioning mists, a gas jetting device may be separately prepared, like U.S. Patent Laid-Open No. 2006/0238561 or Japanese Patent Laid-Open No. 2010-137483 explained in the section of the related art.

Figure 11A:
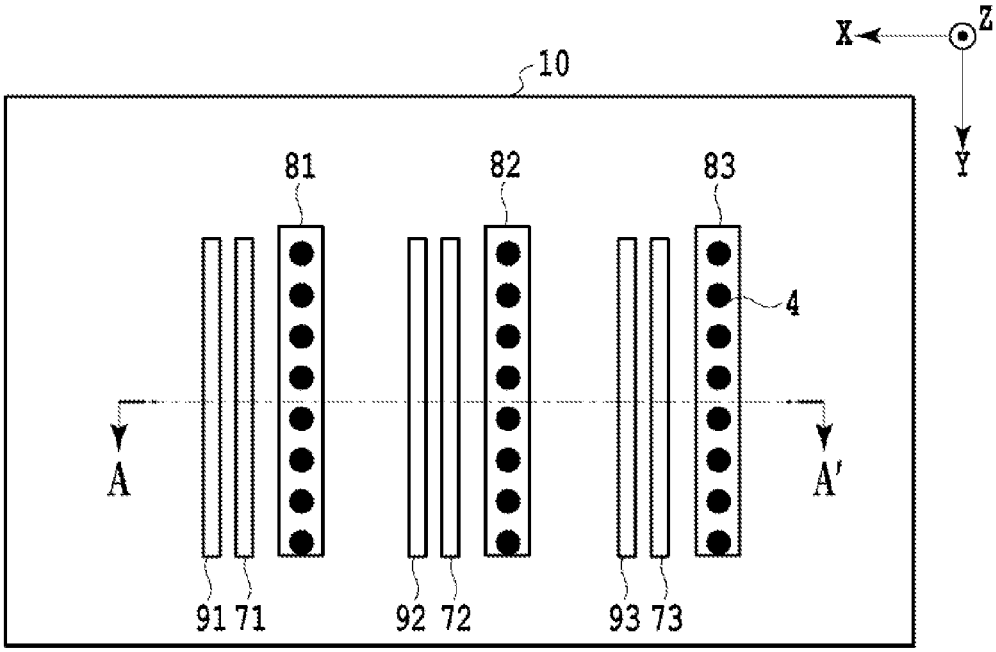
FIGS. 11A and 11B are views showing the configuration in which a gas jetting port is formed at an ejection port formation surface.
Figure 11B:
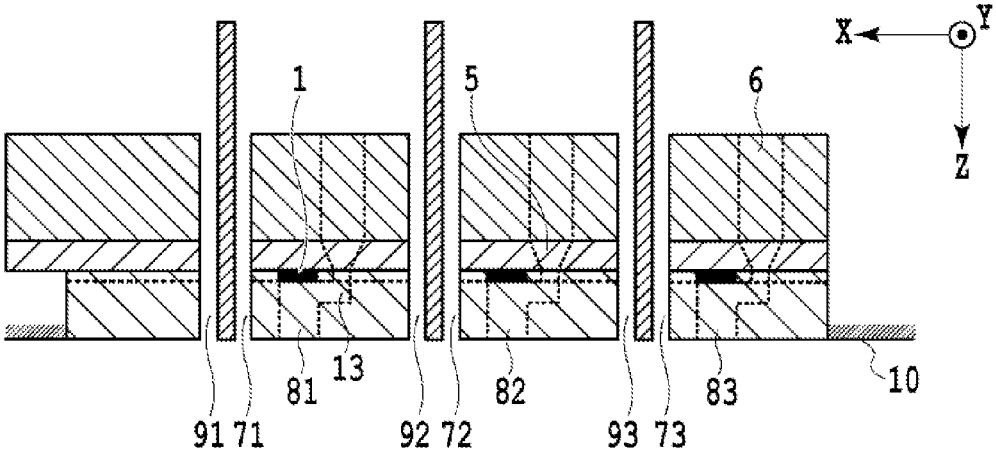

FIGS. 11A and 11B show a configuration in which gas jetting ports 91 to 93 are additionally disposed in the liquid ejecting head described with reference to FIG. 1. As disclosed in U.S. Patent Laid-Open No. 2006/0238561 or Japanese Patent Laid-Open No. 2010-137483, gas jetting ports are formed at appropriate positions so as to positively produce an air stream, thus more efficiently recovering liquid mists at gas suction ports.

Also, in the above description, the liquid suction tube is cylindrical or rectangular. However, the present invention is not limited to such construction. The liquid suction tube may be elliptic cylinder or have polygonal shape. In this case, a smallest inner diameter of the liquid suction tube may be defined as the inner diameter L.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-088521, filed Apr. 19, 2013, and No. 2014-027713, filed Feb. 17, 2014, which are hereby incorporated by reference herein in their entirety.

What is claimed is:

1. A liquid ejecting apparatus for printing an image on a print medium by using a liquid ejecting head for ejecting a liquid, wherein the liquid ejecting head comprises:

a surface having a plurality of ejection ports for ejecting the liquid arranged in a predetermined direction and a plurality of suction ports arranged in the predetermined direction for taking in atmosphere containing mists of the liquid; and a plurality of suction tubes arranged in the predetermined direction and connected to the plurality of suction ports, respectively, for allowing the mists of the liquid taken in through the suction ports to pass therethrough, each of the suction tubes has an inner wall, and an inner diameter L satisfying the following inequality:

$$L \leq (1/2) \cdot \{(12 \cdot \gamma Lv/(\rho \cdot g \cdot \pi)\}^{1/2},$$

wherein ρ designates the density of the liquid; g, gravity acceleration; and γLv, an interfacial energy between the liquid and the inner wall of the suction tube, and wherein the inner diameter L is 250 μm or less.

2. The liquid ejecting head according to claim 1, wherein a gas jetting port for jetting atmosphere is further formed at the surface.

3. A liquid ejecting head comprising:

a surface having a plurality of ejection ports for ejecting a liquid arranged in a predetermined direction and a plurality of suction ports arranged in the predetermined direction for taking in atmosphere containing mists of the liquid; and a plurality of suction tubes arranged in the predetermined direction and connected to the plurality of suction ports, respectively, for allowing the mists of the liquid taken in through the suction ports to pass therethrough, each of the suction tubes has an inner wall, and an inner diameter L satisfying the following inequality:

$$L \leq (1/2) \cdot \{(12 \cdot \gamma Lv/(\rho \cdot g \cdot \pi)\}^{1/2},$$

wherein ρ designates the density of the liquid; g, gravity acceleration; and γLv, an interfacial energy between the liquid and the inner wall of the suction tube, and wherein the inner diameter L is 250 μm or less.

4. The liquid ejecting head according to claim 3, wherein a gas jetting port for jetting atmosphere is further formed at the surface.

5. The liquid ejecting head according to claim 3, wherein the plurality of suction tubes are connected to a negative pressure generating device.

6. The liquid ejecting head according to claim 3, wherein the plurality of suction tubes are defined by regions divided via partitions inside of one tube.

7. The liquid ejecting head according to claim 3, wherein the plurality of suction tubes are cylindrical.

8. The liquid ejecting head according to claim 3, wherein the plurality of suction tubes are rectangular.

* * * * *